US006726793B2

(12) United States Patent
Eiki

(10) Patent No.: US 6,726,793 B2
(45) Date of Patent: Apr. 27, 2004

(54) THERMAL TRANSFER SHEET, THERMAL TRANSFER METHOD AND THERMAL TRANSFER SYSTEM

(75) Inventor: Keisuke Eiki, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 10/008,146

(22) Filed: Nov. 13, 2001

(65) Prior Publication Data

US 2002/0119282 A1 Aug. 29, 2002

(30) Foreign Application Priority Data

Nov. 14, 2000 (JP) ..... 2000-346121

(51) Int. Cl.[7] ..... B41M 5/26

(52) U.S. Cl. ..... 156/235; 347/76.1; 428/32.82; 428/32.85

(58) Field of Search ..... 156/235; 428/32.85, 428/32.82, 195; 347/76.1, 197, 202, 220

(56) References Cited

U.S. PATENT DOCUMENTS 4,725,853 A * 2/1988 Kobayashi et al. ..... 347/197

FOREIGN PATENT DOCUMENTS

| | | |
|---|---|---|
| EP | 0583940 | 2/1994 |
| EP | 0838347 | 4/1998 |

* cited by examiner

*Primary Examiner*—Pamela R. Schwartz
(74) *Attorney, Agent, or Firm*—Ladas & Parry

(57) ABSTRACT

The present invention provides a thermal transfer sheet, a thermal transfer method and a thermal transfer system using said thermal transfer sheet. The thermal transfer sheet provided with a coloring layer disposed on the substrate, wherein the coloring layer is formed of a mixture comprising a copolymerization product (A) obtainable by polymerizing an α-olefin/a maleic acid anhydride copolymer with a maleic acid anhydride monoester and an ethylene/vinyl acetate copolymer (B). The thermal transfer sheet is superior in storage stability in a coiled state, anti-background soiling property and the adaptability to high-speed printing, and also capable of forming a print products having excellent functions as to durability such as wear resistance and heat resistance.

10 Claims, 1 Drawing Sheet

THERMAL TRANSFER SHEET, THERMAL TRANSFER METHOD AND THERMAL TRANSFER SYSTEM

BACKGROUND OF THE INVENTION

1. Field of the Invention

The present invention relates to a thermal transfer sheet and, particularly, to a thermal transfer sheet which has high sensitivity, is adaptable to high-speed printing and causes no problem in various performances such as storage stability, background soiling or the like. The present invention also relates to a thermal transfer method and a thermal transfer system using such a thermal transfer sheet.

2. Description of the Related Art

A melting type thermal transfer system has been known, in which an applicable thermal transfer sheet is composed of a substrate sheet and a coloring layer which is obtained by dispersing a coloring agent such as a pigment or a dye in a heat-meltable binder such as wax or a resin and supported by the substrate sheet such as a plastic film, and energy corresponding to image information is applied to the thermal transfer sheet by means of a heating device such as a thermal head, and thus the coloring agent is transferred from the thermal transfer sheet to an image-receiving sheet such as paper or a plastic sheet together with the binder. A print image formed by this melting type thermal transfer system has high density and superior sharpness and is therefore suitable for the recording of binary images such as characters and line drawings. In addition, when plural coloring layers such as yellow, magenta, cyan and black are printed and recorded on the image-receiving sheet in a superposed manner with the use of one or more thermal transfer sheets, a multicolor or full color image can be formed by subtractive color mixing.

When images such as a bar code for which strict standards as to line width, intervals between lines and length are established are printed by melting transfer system, it is required for a thermal transfer sheet to be provided with a coloring layer having good film-cuttability and to have sharp printing ability. Also, it is required for a print product to have abrasive resistance in order to enable exact reading by a bar code reader and prevent the print portion from being soiled by rubbing in the handling of the print product. For this, many types of thermal transfer sheet provided with a coloring layer primarily comprising a resin such as an acrylic resin or vinyl acetate type resin have been proposed.

When information such as a bar code is recorded by thermal transfer in a transfer-receiving material by using a thermal transfer sheet of the melting type transfer system, high-speed processing (high-speed printing) is required in many applications. In this case, particularly a thermal transfer printer mounted with a so-called end face type thermal head, specifically, provided with a heat generating resistance part at an end surface of a substrate perpendicular to the plane on which a driver IC for driving is disposed is frequently used.

As the thermal transfer sheet used to attain high-speed processing (high-speed printing) in the above thermal transfer recording, one utilizing a material having a high sensitivity is used. However, it is difficult for a thermal transfer print product prepared by using such a thermal transfer sheet provided with a coloring layer made of a highly sensitive resin to be endowed with sufficient performances required for the print product such as durability, heat resistance or the like.

In general, an attempt to improve the coloring layer primarily composed of conventional resins in adaptability to high-speed transfer printing requires use of higher sensitive materials, namely materials having low softening points. However, the use of the material having a low softening point easily causes the so-called blocking phenomenon in which the coloring layer side of the thermal transfer sheet adheres to backface side of the thermal transfer sheet coming in contact with the coloring layer when winding the thermal transfer sheet in a coiled state (namely, a rolled form), or the background soiling via rubbing of the thermal transfer sheet against an image-receiving sheet during the thermal transfer printing, thus being inconvenient.

Japanese Patent Application Laid-open (Kokai) Nos. 5(1993)-104864 and 6(1994)-64339 disclose that a thermo-adhesive resin which is obtained by copolymerizing an α-olefin, one or more kinds of monomer having an α, β-unsaturated double bond and maleic acid anhydride or by subjecting the resin obtained by such a copolymerizing process to esterification with alcohol is used for the adhesive layer or the coloring layer of the thermal transfer sheet to improve transferability to the image-receiving sheet and produce a print product excellent in adhesion property, wear resistance and outdoor durability. However, simple use of such a resin causes decrease of printing density and failure of sensitivity when carrying out the high-speed printing by means of a thermal transfer printer provided with an end face type thermal head.

On the other hand, attempts have been made to dispose a peelable layer or the like in combination with the coloring layer on a substrate of a thermal transfer sheet, in order to allow a print portion to have a multilayer structure and to enable prevention of the blocking phenomenon or the background soiling. For example, in these attempts, an adhesive layer having anti-blocking property or anti-background soiling property is disposed on the coloring layer. However, since one processing step in which the adhesive layer is formed by coating is added to the process for producing the thermal transfer sheet, the process become to require more cost and time, thus being troublesome.

SUMMARY OF THE INVENTION

Accordingly, it is an object of the present invention to solve the aforementioned problems by providing a thermal transfer sheet which is capable of being produced at a low cost, and excellent in adaptability to the high-speed printing, and cause no problem in storage stability in a coiled state, background soiling of the print product or the like.

In order to attain the above object, a thermal transfer sheet according to the present invention comprises a substrate and a coloring layer disposed on one side of the substrate, wherein the coloring layer is formed of a mixture comprising a copolymerization product (A) which is obtainable by polymerizing an α-olefin/a maleic acid anhydride copolymer with a maleic acid anhydride monoester and an ethylene/vinyl acetate copolymer (B) which comprises a high viscous ethylene/vinyl acetate copolymer having a melt index in a range of 5 to 150 and a low viscous ethylene/vinyl acetate copolymer having a melt index in a range of 150 to 2400.

The melt index referred in the present invention is defined as the melt flow rate (MFR, unit:g/10 g) which is measured at a temperature of 190° C. and a load of 2160 g under a condition in accordance with JIS K 7210. All measured values of MI (MFR) appearing hereunder will be described on the basis of this method.

In the present invention, since the above polymerization product (A) is contained in the coloring layer, a blocking phenomenon of the thermal transfer sheet during storage in a coiled state can particularly be prevented.

Further since the above copolymer (B) is contained in the coloring layer, decrease of the print density is not caused even at the high-speed printing, and a combination use of the high viscous and the low viscous ethylene/vinyl acetate copolymers further improves transferability of the coloring layer at the high-speed printing. Thus, the thermal transfer sheet is superior in the printing quality.

Further, since the copolymerization product (A) and the copolymer (B) are blended to form the coloring layer, a thermal transfer sheet which is superior in the storage stability in a coiled state, the anti-background soiling property and the adaptability to high-speed printing, and also capable of forming a print products having excellent functions as to durability such as wear resistance and heat resistance, and is well-balanced between various performances can be provided.

Further, it is preferable that a peelable layer containing wax as its primary component is further disposed between said coloring layer and said substrate.

The peelable layer is molten at the thermal transfer process and improves the peelability of the coloring layer from the substrate, and after transferred, at least a part of the peelable layer is transferred together with the coloring layer to cover the transferred coloring layer, it serves as a protective layer of the coloring layer and particularly imparts a good lubricity to a transferred image, thus improving anti-wear property.

The thermal transfer sheet of the present invention is preferably used in a printing system using a thermal transfer printer provided with an end face type thermal head. This makes it possible to carry out thermal transfer recording in high-speed printing.

DETAILED DESCRIPTION OF THE PREFERRED EMBODIMENT

Figure 1:
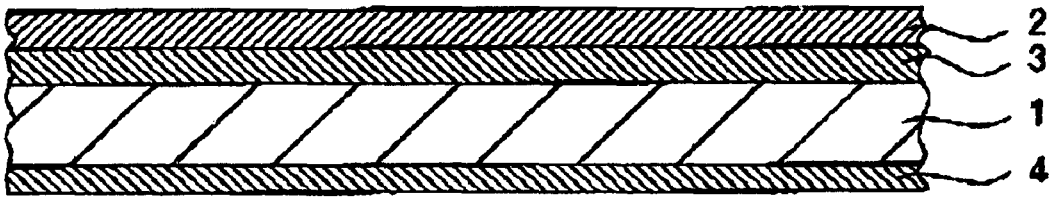
FIG. 1 is a schematically sectional view showing an example of a thermal transfer sheet according to the present invention.

Next, an embodiment according to the present invention will be explained in detail. FIG. 1 shows a layered structure of one embodiment of the thermal transfer sheet of the present invention, in which a peelable layer 3 and a coloring layer 2 are disposed in this order on one surface of a substrate 1, and a heat resistant layer 4 is disposed on the other surface of the substrate. The fundamental form of a thermal transfer sheet according to the present invention is a structure in which at least a coloring layer 2 is disposed on at least one surface of a substrate 1. The other layer may be provided on one or both sides of the substrate as required. A peelable layer 3 may be disposed between the coloring layer and the substrate and also, a heat resistant layer 4 may be disposed on the other surface of the substrate.

Each layer constituting the thermal transfer sheet of the present invention will be hereinafter explained in detail.

Substrate

As the substrate used for the thermal transfer sheet of the present invention, not only the same substrate as those used for the conventional thermal transfer sheet may be used as it is but also other substrates may be used and there is no particular limitation to the type of substrate. Specific examples preferably used as the substrate include films of plastics such as a polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated rubber and ionomer; papers such as condenser paper and paraffin paper; and nonwoven fabric. Composite substrates obtainable by laminating these substrates may also be used. A particularly preferable substrate is a polyethylene terephthalate film. The thickness of the substrate is preferably, for example, about 2 to 10 $\mu$m though it may be changed corresponding to the type of material to obtain proper strength and heat conductivity.

Coloring Layer

The coloring layer of the thermal transfer sheet of the present invention is obtained in the following manner. Specifically, a coating liquid prepared by dissolving or dispersing at least a coloring agent and a binder in a solvent and by further adding additives such as a plasticizer, surfactant, lubricant and fluidity regulator as occasion demand is applied to the substrate in an amount of about 0.1 to 5 g/m$^2$ and preferably about 0.3 to 1.5 g/m$^2$ in a dry state by a conventionally known method such as hot melt coating, hot lacquer coating, gravure direct coating, gravure reverse coating, knife coating, air coating, roll coating or wire bar coating.

When the amount of a dry coating film is less than 0.1 g/m$^2$, a uniform ink layer cannot be obtained on account of a problem concerning film forming property. Also, when the coating amount exceeds 5 g/m$^2$, high energy is required when printing and transfer operations are carried out, giving rise to the problem that printing can be made only by means of a special thermal transfer printer.

For the coloring agent, each coloring agent such as yellow, magenta, cyan, black or white color maybe optionally selected from conventionally known dyes and pigments.

The coloring layer uses, as a primary component of the binder, a mixture of a copolymerization product (A) obtainable by copolymerizing an $\alpha$-olefin/a maleic acid anhydride copolymer with a maleic acid anhydride monoester and an ethylene/vinyl acetate copolymer (B).

The aforementioned copolymerization product (A) is a copolymer obtainable by copolymerizing an $\alpha$-olefin/a maleic acid anhydride copolymer as a first unit and a maleic acid anhydride monoester as a second unit. It is available as a commercial product, for example Ceramer series manufactured by Petrolite Corporation. Among the Ceramer series, for example Ceramer 1608 is a copolymerization product of "a copolymer of an $\alpha$-olefin and maleic acid anhydride" and "a maleic acid anhydride monoisopropylester" and is preferably used.

The above copolymerization product (A) has a melting point of about 60 to 80° C. and serves to suppress the occurrence of blocking between the coloring layer and the substrate backface side while the thermal transfer sheet is stored mainly in a coiled state to ensure the fixing ability of the coloring layer to image-receiving sheet during thermal transfer. Also, the aforementioned copolymerization product (A) has the characteristics difficult of deterioration in transferability to a transfer-receiving material in high-speed printing.

The ethylene/vinyl acetate copolymer (B) to be contained in the coloring layer is a copolymer obtainable by copolymerizing ethylene with vinyl acetate. Among the copolymer (B), one having a melting point of about 50 to 70° C., containing a vinyl acetate component in a ratio (VA) by weight of about 19 to 33%. As the ethylene/vinyl acetate copolymer (B), it is preferable to use a mixture of two or more kinds of ethylene/vinyl acetate copolymers containing at least a high viscous ethylene/vinyl acetate copolymer having a melt index (MI) in a range of 5 to 150 and a low viscous ethylene/vinyl acetate copolymer having a melt index (MI) in a range of 150 to 2400. That is, one or more kinds of the high viscous ethylene/vinyl acetate copolymers is selected from the range of 5 to 150 in the melt index, and one or more kinds of the low viscous ethylene/vinyl acetate copolymers is also selected from the range of 150 to 2400 in the melt index, and the selected high and low viscous ethylene/vinyl acetate copolymers are mixed with each other, thus preparing a preferable ethylene/vinyl acetate copolymer (B).

The melt index referred in the present invention is defined as the melt flow rate (MFR, unit:g/10 g) which is measured at a temperature of 190° C. and a load of 2160 g under a condition in accordance with JIS K 7210.

The high viscous ethylene/vinyl acetate copolymer prevents that a softened ink is excessively permeate the image-receiving sheet at the high-speed printing process, and that the coloring layer remains on a thermal transfer sheet at the printing, and thereby enabling prevention of decrease in printing density. However, the high viscous ethylene/vinyl acetate copolymer has a high viscosity and a high melting point, and when such a high viscous ethylene/vinyl acetate copolymer is only used for the coloring layer in no combination with the low viscous one, sensitivity is liable to be insufficient at the printing.

On the other hand, the low viscous ethylene/vinyl acetate copolymer has a low melting point in general, and it is therefore rapidly molten at the high-speed printing process, and thereby enabling formation of an image on the image-receiving sheet. However, the low viscous ethylene/vinyl acetate copolymer has an excessively low viscosity, and when such a low viscous ethylene/vinyl acetate copolymer is only used for the coloring layer in no combination with the high viscous one, a softened ink is excessively permeate the image-receiving sheet, and the coloring layer remains on a thermal transfer sheet at the printing with result that decrease of printing density is easily caused.

As mentioned above, for the purpose of eliminating drawbacks caused by single use of the high viscous ethylene/vinyl acetate copolymer or the low viscous one, the high viscous and the low viscous ethylene/vinyl acetate copolymers are mixed with each other and used, and thereby obtaining the thermal transfer sheet which can carry out a transfer process with no occurrence of decrease of density and failure of sensitivity in the print product even at the high-speed printing.

Whether the ethylene/vinyl acetate copolymer is high viscous or low viscous, when it is used for the coloring layer to produce the thermal transfer sheet, the obtained thermal transfer sheet is liable to be caused blocking during preservation in the coiled state. In contrast with this problem, the thermal transfer sheet can be endowed with storage stability in the coiled state by using the copolymerization product (A) obtainable by polymerizing an α-olefin/a maleic acid anhydride copolymer with a maleic acid anhydride monoester for forming the coloring layer.

The mixing ratio by weight of the above copolymerization product (A) to the above copolymer (B) is about 1/3 to 3/1 in terms of the copolymerization product (A)/the copolymer (B).

In a case where the high viscous and the low viscous ethylene/vinyl acetate copolymers are mixed and used, the mixing ratio by weight thereof is about 1/9 to 9/1, and preferably about 3/7 to 7/3 in terms of the high viscous type/the low viscous type, whether containing one or two kinds of the high viscous type or one or two kinds of the low viscous type.

The coloring layer can be formed by dissolving or dispersing the copolymerization product (A) and the copolymer (B) mentioned above respectively, and further adding the other thermoplastic resin, wax, additives or the like as occasion demand within the extent that functions to be served by the coloring layer of the present invention suffer no obstruction in a proper organic solvent or water to prepare a coating liquid for forming the coloring layer, coating the prepared coating liquid by a common coating means conventionally known, and drying the same.

It is preferable to form the coloring layer from an ink composition containing 20 to 70% by weight of the coloring agent and 80 to 30% by weight of the binder. When an amount of the coloring agent is smaller than the above mentioned range, a coating amount has to be increased in order to ensure a necessary extent of density, and a print sensitivity is deteriorated. To the contrary, when an amount of the coloring agent is larger than the above mentioned range, a film forming property can not ensured, and anti-wear property is deteriorated after the printing.

Peelable Layer

The thermal transfer sheet of the present invention may be provided with a peelable layer between the substrate and the coloring layer. The peelable layer is molten at the thermal transfer process and improves the peelability of the coloring layer from the substrate, and after transferred, at least a part of the peelable layer is transferred together with the coloring layer to cover the transferred coloring layer, it serves as a protective layer of the coloring layer and particularly imparts a good lubricity to a transferred image, thus improving anti-wear property. As a material forming the peelable layer, various resin and waxes having highly peelable ability may be used, and the materials include acrylic resins, silicone resins, fluororesins or various resins modified by silicone or fluorine. It is preferable to use wax as a primary component.

As this wax, various waxes which melt during printing to exhibit high peelability are preferable, Examples of the wax which is preferably used include various waxes such as microcrystalline wax, carnauba wax, paraffin wax, Fisher-Tropsch wax, various low molecular polyethylenes, haze wax, beeswax, spermaceti wax, insect wax, wool wax, shellac wax, candelilla wax, petrolatum, partially denatured wax, fatty acid ester and fatty acid amide. Among these waxes, particularly preferable wax is microcrystalline wax or carnauba wax which has a relatively high melting point and is hardly soluble in a solvent.

The aforementioned peelable layer is preferably made into a thin layer with, for example, a thickness of about 0.1 to 2 g/m$^2$ in a dry state so as to prevent the sensitivity of the thermal transfer sheet from decreasing.

Heat Resistant Layer

In the present invention, a heat resistant layer which improves the lubricity of a thermal head and prevents sticking is preferably disposed on the surface which is in contact with a thermal head, namely on the side opposite to the side of the substrate on which side the coloring layer is disposed when, for example, a material which is low in heat tolerance is used as the substrate. The heat resistant layer is fundamentally composed of a heat resistant resin and a material functioning as a thermal releasing agent or a lubricant. The provision of such a heat resistant layer ensures that thermal transfer printing can be carried out without sticking even in the case of a thermal transfer sheet using a material which has a low degree of heat tolerance as the substrate, exhibiting the merits of the plastic film such as resistance to cutting and high processability.

This heat resistant layer is formed by appropriately using a composition obtained by adding a lubricant, surfactant, inorganic particle, organic particle, pigment or the like to a binder resin. Examples of the binder resin to be used for the heat resistant layer include cellulose type resins such as ethyl cellulose, hydroxyethyl cellulose, hydroxypropyl cellulose, methyl cellulose, cellulose acetate, cellulose acetate butyrate and cellulose nitrate; vinyl type resins such as polyvinyl alcohol, polyvinyl acetate, polyvinylbutyral, polyvinylacetal, polyvinylpyrrolidone, acrylic resins, polyacrylamide, and acrylonitrile/styrene copolymers; polyester resins; polyurethane resins; and silicone-modified or fluorine-modified urethane resins.

Among these resins, those having several reactive groups, for example, hydroxyl groups are preferably used as the crosslinkable resin by combination use with a polyisocyanate as a crosslinking agent. As to a method forming the heat resistant layer, a material prepared by adding a lubricant, surfactant, inorganic particle, organic particle, pigment or the like to the binder resin as aforementioned is dissolved or dispersed in a proper solvent to prepare a coating liquid, which is then applied using a common coating means such as a gravure coater, roll coater or wire bar, followed by drying.

EXAMPLES

Next, the present invention will be explained in more detail by way of examples, in which all designations of parts and % are expressed on weight basis, unless otherwise noted.

Example 1

As the substrate, a polyethylene terephthalate film (Lumirror, manufactured by Toray Industries, Inc.) with a thickness of 4.5 $\mu$m was used. A coating liquid for a heat resistant layer which contains a silicone/acryl copolymer (Saimakku, manufactured by Toua Gousei Co., Ltd.) was applied to one surface of the above substrate in advance by gravure coating in a dry coating amount of 0.1 g/m$^2$ and dried to form a heat resistant layer.

Next, a coating liquid having the following composition for a peelable layer was applied to the other surface of the above substrate by gravure coating in a dry coating amount of 0.7 g/m$^2$ and dried to form a peelable layer. Further, a coating liquid having the following composition for a coloring layer was applied to the peelable layer by gravure coating in a dry coating amount of 1.0 g/m$^2$ and dried to form a coloring layer, thereby producing a thermal transfer sheet of Example 1.

Coating Liquid for a Peelable Layer

| | |
|---|---|
| Carnauba wax emulsion (manufactured by Konishi Co., Ltd., solid content: 40%): | 100 parts |
| Water: | 100 parts |
| Isopropyl alcohol: | 100 parts |

Coating Liquid for a Coloring Layer

| | |
|---|---|
| Carbon black: | 30 parts |
| Ethylene/vinyl acetate copolymer (VA = 28%, MI = 15): | 40 parts |
| Ethylene/vinyl acetate copolymer (VA = 28%, MI = 400): | 40 parts |
| Copolymer product of α-olefin/maleic acid anhydride copolymer and maleic acid anhydride monoisopropylester (Ceramer 1608, manufactured by Petrolite Corporation): | 35 parts |
| Methyl ethyl ketone: | 20 parts |
| Toluene: | 400 parts |

Example 2

A thermal transfer sheet of Example 2 was produced in the same manner as in Example 1 except that the composition of the coating liquid for a coloring layer in the thermal transfer sheet of the above Example 1 was altered to the following composition.

Coating Liquid for a Coloring Layer

| | |
|---|---|
| Carbon black: | 40 parts |
| Ethylene/vinyl acetate copolymer (VA = 28%, MI = 15): | 40 parts |
| Ethylene/vinyl acetate copolymer (VA = 28%, MI = 150): | 40 parts |
| Copolymer product of α-olefin/maleic acid anhydride copolymer and maleic acid anhydride monoisopropylester (Ceramer 1608, manufactured by Petrolite Corporation): | 35 parts |
| Methyl ethyl ketone: | 20 parts |
| Toluene: | 400 parts |

Example 3

A thermal transfer sheet of Example 3 was produced in the same manner as in Example 1 except that the composition of the coating liquid for a peelable layer in the thermal transfer sheet produced in the above Example 1 was altered to the following composition.

Coating Liquid for a Peelable Layer

| | |
|---|---|
| Carnauba wax emulsion (manufactured by Konishi Co., Ltd., solid content: 40%): | 100 parts |
| Candelilla wax emulsion (manufactured by Konishi Co., Ltd., solid content: 35%): | 100 parts |
| Water: | 200 parts |
| Isopropyl alcohol: | 200 parts |

Comparative Example 1

A thermal transfer sheet of Comparative Example 1 was produced in the same manner as in Example 1 except that the composition of the coating liquid for a coloring layer in the thermal transfer sheet produced in the above Example 1 was altered to the following composition.

Coating Liquid for a Coloring Layer

| | |
|---|---|
| Carbon black: | 25 parts |
| Ethylene/vinyl acetate copolymer (VA = 28%, MI = 15): | 40 parts |
| Copolymer product of α-olefin/maleic acid anhydride copolymer and maleic acid anhydride monoisopropylester (Ceramer 1608, manufactured by Petrolite Corporation): | 35 parts |
| Methyl ethyl ketone: | 13 parts |
| Toluene: | 260 parts |

Comparative Example 2

A thermal transfer sheet of Comparative Example 2 was produced in the same manner as in Example 1 except that the composition of the coating liquid for a coloring layer in the thermal transfer sheet produced in the above Example 1 was altered to the following composition.

Coating Liquid for a Coloring Layer

| | |
|---|---|
| Carbon black: | 25 parts |
| Ethylene/vinyl acetate copolymer (VA = 28%, MI = 400): | 40 parts |
| Copolymer product of α-olefin/maleic acid anhydride copolymer and maleic acid anhydride monoisopropylester (Ceramer 1608, manufactured by Petrolite Corporation): | 35 parts |
| Methyl ethyl ketone: | 13 parts |
| Toluene: | 260 parts |

Comparative Example 3

A thermal transfer sheet of Comparative Example 3 was produced in the same manner as in Example 1 except that the compositions of the coating liquids for a coloring layer in the thermal transfer sheet produced in the above Example 1 was altered to the following composition.

Coating Liquid for a Coloring Layer

| | |
|---|---|
| Carbon black: | 40 parts |
| Ethylene/vinyl acetate copolymer (VA = 28%, MI = 15): | 40 parts |
| Ethylene/vinyl acetate copolymer (VA = 28%, MI = 150): | 40 parts |
| Methyl ethyl ketone: | 16 parts |
| Toluene: | 312 parts |

Test

Using the thermal transfer sheets of the above Examples and Comparative Examples, printing was carried out in the following printing condition and the print products were evaluated for adaptability to high-speed printing, durability and background soiling according to the following evaluation method. Further, each thermal transfer sheet was wound in a coiled state to evaluate for anti-blocking property.

Printing Condition

As a printer, TTX450 (mounted with an end face type thermal head) manufactured by AVERY DENNISON was used and a bar code pattern was printed on a coated paper at a printing speed of 10 inch/sec.

Evaluation of Adaptability to High-speed Printing

The state of the transferred bar code in the print product obtained in the above printing condition was visually observed to evaluate the state according to the following decision criteria.

Criteria

◎: Transfer of the bar code is very well.

○: Transfer of the bar code is well.

Δ: Transfer of the bar code is partially inferior.

X: Transfer of the bar code is inferior overall.

Evaluation of Durability

In each of the above print products, the print portion was rubbed by the following method and the state of the rubbed surface of the print product was visually observed to evaluate the durability according to the following decision criteria.

Rubbing Test

Tester: Wear tester manufactured by Suga Test Instruments Co., Ltd.

Load: 500 g

Moving speed: 30 mm/sec

Number of reciprocating: 100 times

Applied cloth: Shirting No. 3

Criteria

◎: Falling of the print portion is not observed at all and soiling of the background is not observed at all.

○: Falling of the print portion is not almost observed but soiling of the background is observed a little.

Δ: Falling of the print portion is observed a little and soiling of the background is observed.

X: Falling of the print portion is significant and a remarkable soiling of the background is observed.

Evaluation of Anti-background Soiling Property

In the print product obtained in the aforementioned printing condition, the state of the soiling of the non-printed portion was visually observed to evaluate the anti-background soiling property according to the following criteria.

Criteria

○: Soiling of the non-printed portion is not almost observed.

X: Soiling of the non-printed portion is remarkable.

Evaluation of Anti-blocking Property

Next, each thermal transfer sheet produced above was examined in its anti-blocking property in the following condition to evaluate according to the following criteria.

Each sample was wound in a coiled state with a length of 240 m, stored for 2 days under 50° C. and 85% RH, and then wound back to examine a state of the sample as to the generation of blocking. That is, state of the both surfaces of the thermal transfer sheet including a side on which the coloring layer was formed and the opposite side thereto were visually observed to examine whether foreign substances were stuck or not and also to examine whether the layer was fallen off or not. The evaluation of the sample was made according to the following criteria.

Criteria

○: No blocking was observed, exhibiting a high anti-blocking property.

X: Blocking was observed, exhibiting a inferior blocking resistance.

Result of Evaluation

The results of the evaluation of the above Examples and Comparative Examples are shown in Table 1.

The thermal transfer sheets obtained in the Examples 1 to 3 exhibited a good performance with good balance at all points including the adaptability to high-speed printing, the Durability required for a print product, the anti-background soiling property and the storage stability in a coiled state (namely, the anti-blocking property).

In contrast with those Examples, the Comparative Example 1 caused an obstruction of transferring at the high-speed printing and could not produce a print product, and thus the durability of the printed product could not evaluated. The Comparative Example 2 was inferior in the print density at the high-speed printing. The Comparative Example 3 was inferior in the durability of a printed product, the anti-background soiling property and the storage stability in the coiled state (namely, the anti-blocking property).

TABLE 1

| | Adaptability to high-speed printing | Durability of print product | Background soiling | Anti-blocking property |
|---|---|---|---|---|
| Example 1 | ◎ | ◎ | ○ | ○ |
| Example 2 | ○ | ◎ | ○ | ○ |
| Example 3 | ◎ | ○ | ○ | ○ |
| Comparative Example 1 | X | — | ○ | ○ |
| Comparative Example 2 | X | ○ | ○ | ○ |
| Comparative Example 3 | ○ | X | X | X |

As stated above, the thermal transfer sheet according to the present invention comprises a substrate and a coloring layer disposed on at least one side of the substrate, wherein the coloring layer is formed of a mixture at least containing a polymerization product (A) which is obtainable by copolymerizing an α-olefin/a maleic acid anhydride copolymer with a maleic acid anhydride monoester copolymer and an ethylene/vinyl acetate copolymer (B) which comprises a combination of the high viscous and the low viscous ethylene/vinyl acetate copolymers.

Since the above polymerization product (A) is contained in the coloring layer, a blocking phenomenon of the thermal transfer sheet during storage in a coiled state can particularly be prevented.

Further since the above copolymer (B) is contained in the coloring layer, decrease of the print density is not caused even at the high-speed printing, and a combination use of the high viscous and the low viscous ethylene/vinyl acetate copolymers further improves transferability of the coloring layer at the high-speed printing. Thus, the thermal transfer sheet is superior in the printing quality.

Further, since the copolymerization product (A) and the copolymer (B) are blended to form the coloring layer, a thermal transfer sheet which is superior in the storage stability in a coiled state, the anti-background soiling property and the adaptability to high-speed printing, and also capable of forming a print products having excellent functions as to durability such as wear resistance and heat resistance, and is well-balanced between various performances can be provided.

What is claimed is:

1. A thermal transfer sheet comprising a substrate and a coloring layer disposed on one side of the substrate, wherein the coloring layer is formed of a mixture comprising a copolymerization product (A) which is obtainable by polymerizing an α-olefin/a maleic acid anhydride copolymer with a maleic acid anhydride monoester and an ethylene/vinyl acetate copolymer (B) which comprises a mixture of high viscous ethylene/vinyl acetate copolymer having a melt index in a range of 5 to 150 and a low viscous ethylene/vinyl acetate copolymer having a melt index in a range of 150 to 2400.

2. A thermal transfer sheet according to claim 1, wherein the mixing ratio by weight of said copolymerization product (A) and said copolymer (B) is in a range of 1/3 to 3/1 in terms of the copolymerization product (A)/the copolymer (B).

3. A thermal transfer sheet according to claim 1, wherein the mixing ratio by weight of said high viscous ethylene/vinyl acetate copolymer and said low viscous ethylene/vinyl acetate copolymer is in a range of 3/7 to 7/3 in terms of <the high viscous ethylene/vinyl acetate copolymer>/<the low viscous ethylene/vinyl acetate copolymer>.

4. A thermal transfer sheet according to claim 1, wherein a peelable layer containing wax is further disposed between said coloring layer and said substrate.

5. A thermal transfer method comprising steps of:

providing a thermal transfer sheet comprising a substrate and a coloring layer disposed on one side of the substrate, wherein the coloring layer is formed of a mixture comprising a copolymerization product (A) which is obtainable copolymerizing an α-olefin/a maleic acid anhydride copolymer with a maleic acid anhydride monoester and an ethylene/vinyl acetate copolymer (B) which comprises a mixture of high viscous ethylene/vinyl acetate copolymer having a melt index in a range of 5 to 150 and a low viscous ethylene/vinyl acetate copolymer having a melt index in a range of 150 to 2400, and carrying out the printing by heating the thermal transfer sheet by means of a thermal transfer printer having an end face type thermal head.

6. A thermal transfer method according to claim 5, wherein the mixing ratio by weight of said copolymerization product (A) and said copolymer (B) is in a range of 1/3 to 3/1 in terms of the copolymerization product (A)/the copolymer (B).

7. A thermal transfer method according to claim 5, wherein the mixing ratio by weight of said high viscous ethylene/vinyl acetate copolymer and said low viscous ethylene/vinyl acetate copolymer is in a range of 3/7 to 7/3 in terms of <the high viscous ethylene/vinyl acetate copolymer>/<the low viscous ethylene/vinyl acetate copolymer>.

8. A thermal transfer system comprising:

a thermal transfer sheet comprising a substrate and a coloring layer disposed on one side of the substrate, wherein the coloring layer is formed of a mixture comprising a copolymerization product (A) which is obtainable by polymerizing an α-olefin/a maleic acid anhydride copolymer with a maleic acid anhydride monoester and an ethylene/vinyl acetate copolymer (B) which comprises a mixture of high viscous ethylene/vinyl acetate copolymer having a melt index in a range of 5 to 150 and a low viscous ethylene/vinyl acetate copolymer having a melt index in a range of 150 to 2400, and a thermal transfer printer having an end face type thermal head for heating the thermal transfer sheet according to the image information.

9. A thermal transfer system according to claim 8, wherein the mixing ratio by weight of said copolymerization product (A) and said copolymer (B) is in a range of 1/3 to 3/1 in terms of the copolymerization product (A)/the copolymer (B).

10. A thermal transfer system according to claim 8, wherein the mixing ratio by weight of said high viscous ethylene/vinyl acetate copolymer and said low viscous ethylene/vinyl acetate copolymer is in a range of 3/7 to 7/3 in terms of <the high viscous ethylene/vinyl acetate copolymer>/<the low viscous ethylene/vinyl acetate copolymer>.

* * * * *